US009202451B2

(12) United States Patent
Wei

(10) Patent No.: US 9,202,451 B2
(45) Date of Patent: Dec. 1, 2015

(54) DETACHABLE ELECTRONIC DRUM

(71) Applicant: AI-Musics Technology Inc., New Taipei (TW)

(72) Inventor: Guo-Hsiung Wei, New Taipei (TW)

(73) Assignee: AI-MUSICS TECHNOLOGY INC., New Taipei (TW)

( * ) Notice: Subject to any disclaimer, the term of this patent is extended or adjusted under 35 U.S.C. 154(b) by 41 days.

(21) Appl. No.: 14/250,624

(22) Filed: Apr. 11, 2014

(65) Prior Publication Data

US 2014/0216234 A1 Aug. 7, 2014

Related U.S. Application Data

(63) Continuation-in-part of application No. 13/541,801, filed on Jul. 5, 2012, now Pat. No. 8,841,538.

(51) Int. Cl.

| | |
|---|---|
| ***G10H 1/32*** | (2006.01) |
| ***G10H 3/00*** | (2006.01) |
| ***G10H 3/14*** | (2006.01) |
| ***G10D 13/02*** | (2006.01) |
| ***G10H 1/00*** | (2006.01) |

(52) U.S. Cl.

CPC ..... *G10H 3/146* (2013.01); *G10D 13/024* (2013.01); *G10H 1/00* (2013.01); *G10H 1/32* (2013.01); *G10H 3/14* (2013.01); *G10H 2230/275* (2013.01)

(58) Field of Classification Search

CPC ... G10H 2220/525; G10H 1/00; G10H 3/146; G10H 2230/275; G10H 3/14; G10H 2230/281; G10H 2230/305; G10H 2230/285; G10H 2230/291; G10H 2230/311; G10H 2250/435; G09B 15/04; G09B 9/28; G10C 3/06

See application file for complete search history.

(56) References Cited

U.S. PATENT DOCUMENTS

| | | | | |
|---|---|---|---|---|
| 5,583,307 | A * | 12/1996 | Tobia, Jr. | 84/411 R |
| 5,585,581 | A * | 12/1996 | Rogers | 84/414 |
| 8,563,843 | B1 * | 10/2013 | Shemesh | 84/743 |
| 8,841,527 | B2 * | 9/2014 | Shih et al. | 84/104 |
| 2004/0200338 | A1 * | 10/2004 | Pangrle | 84/724 |
| 2005/0211062 | A1 * | 9/2005 | Hiraku | 84/414 |
| 2012/0097009 | A1 * | 4/2012 | Eventoff et al. | 84/413 |
| 2013/0340598 | A1 * | 12/2013 | Marquez et al. | 84/730 |
| 2014/0165822 | A1 * | 6/2014 | Mori | 84/738 |
| 2015/0179154 | A1 * | 6/2015 | Takegawa | 84/723 |

* cited by examiner

*Primary Examiner* — Marlon Fletcher
(74) *Attorney, Agent, or Firm* — Han IP Corporation

(57) ABSTRACT

Various embodiments of a detachable electronic drum are described. In one aspect, an electronic drum includes a main support base having a central portion and a periphery surrounding the central portion, a striking unit disposed on the central portion of the main support base, an annular top cover disposed over and around the striking unit such that the striking unit is disposed between the main support base and the annular top cover, and an annular elastic collar coupled to the periphery of the main support base. The annular elastic collar is configured to hook to a drum hoop of a conventional drum when the electronic drum is attached to the conventional drum and disposed over a drumhead of the conventional drum such that no other portion of the electronic drum is in contact with the conventional drum.

20 Claims, 17 Drawing Sheets

DETACHABLE ELECTRONIC DRUM

CROSS REFERENCE TO RELATED PATENT APPLICATION

This is a continuation-in-part application claiming the priority benefit of U.S. patent application Ser. No. 13/541,801, entitled "Detachable Electronic Drum" and filed on Jul. 5, 2012, which is herein incorporated by reference.

TECHNICAL FIELD

The present disclosure relates to an electronic drum, and more particularly to a detachable electronic drum that can be easily and conveniently attached to and detached from a drum.

BACKGROUND

Drums, such as Jazz tom-tom are popular and are widely used in pop, jazz, heavy metal or symphony. With reference FIG. 9, a conventional drum 80 comprises a hollow body, two holding rims 82 and two drumheads 81. The drumheads 81 are respectively mounted securely on two opening ends of the body with the holding rims 82 to respectively close the opening ends of the body. When one of the drumheads 81 is beaten, acoustic sound will generate with the resonance of the hollow body.

With reference to FIG. 10, an electronic drum comprises a solid induction board 90, a sensor 91 and an elastic drumhead 92. The drumhead 92 is made of an elastic material, such as rubber, and the sensor 91 is mounted beneath the drumhead 92. When the drumhead 92 is beaten, the sensor 91 detects the beats and sends signals to a speaker or an earphone that is electrically connected with the electronic drum to generate acoustic sound from the speaker or the earphone.

However, the acoustic sound generated by the conventional drum is strong and solid but the sound volume cannot be adjusted, so that to play the convention al drum easily noises the other people. The acoustic sound generated by the electronic drum can be adjusted but is not strong and solid as that generated by the conventional drum. Therefore, a drummer will play music with the conventional drums and practice with the electronic drums. However, to play or practice music, multiple conventional drums and electronic drums of different kinds are necessary. The user has to attach and detach the conventional drums and the electronic drums onto or from a stand for playing music or to practicing, and this is trouble and time-consuming and inconvenient in use.

In addition, U.S. Pat. No. 8,039,724 disclosed another electronic drum, but the electronic drum of the '724 Patent is mounted beneath the drumhead of a drum. Therefore, to attach or detach the electronic drum onto or from the drum is trouble and time-consuming.

To overcome the shortcomings, the present disclosure tends to provide an electronic drum to mitigate or obviate the aforementioned problems.

SUMMARY

The main objective of the present disclosure is to provide a detachable electronic drum that can be easily and conveniently attached to and detached from a drum.

The electronic drum has an induction board and a securing frame. The induction board has a drumhead, a connection device and a detecting assembly. The connection device is adapted to be electrically connected with an outer acoustic device. The detecting assembly is mounted under the drumhead and is electrically connected with the connection device to detect beats on the drumhead and to send acoustic signal to the connection device. The annular securing frame is mounted around the induction board and has an annular bracket, an outer securing rib and a bottom securing rib. The annular bracket has an outer periphery and a bottom. The outer securing rib protrudes outward from the outer periphery of the annular bracket. The bottom securing rib protrudes from the bottom of the annular bracket.

Other objects, advantages and novel features of the present disclosure will become more apparent from the following detailed description when taken in conjunction with the accompanying drawings.

DETAILED DESCRIPTION OF PREFERRED EMBODIMENTS

Figure 1:
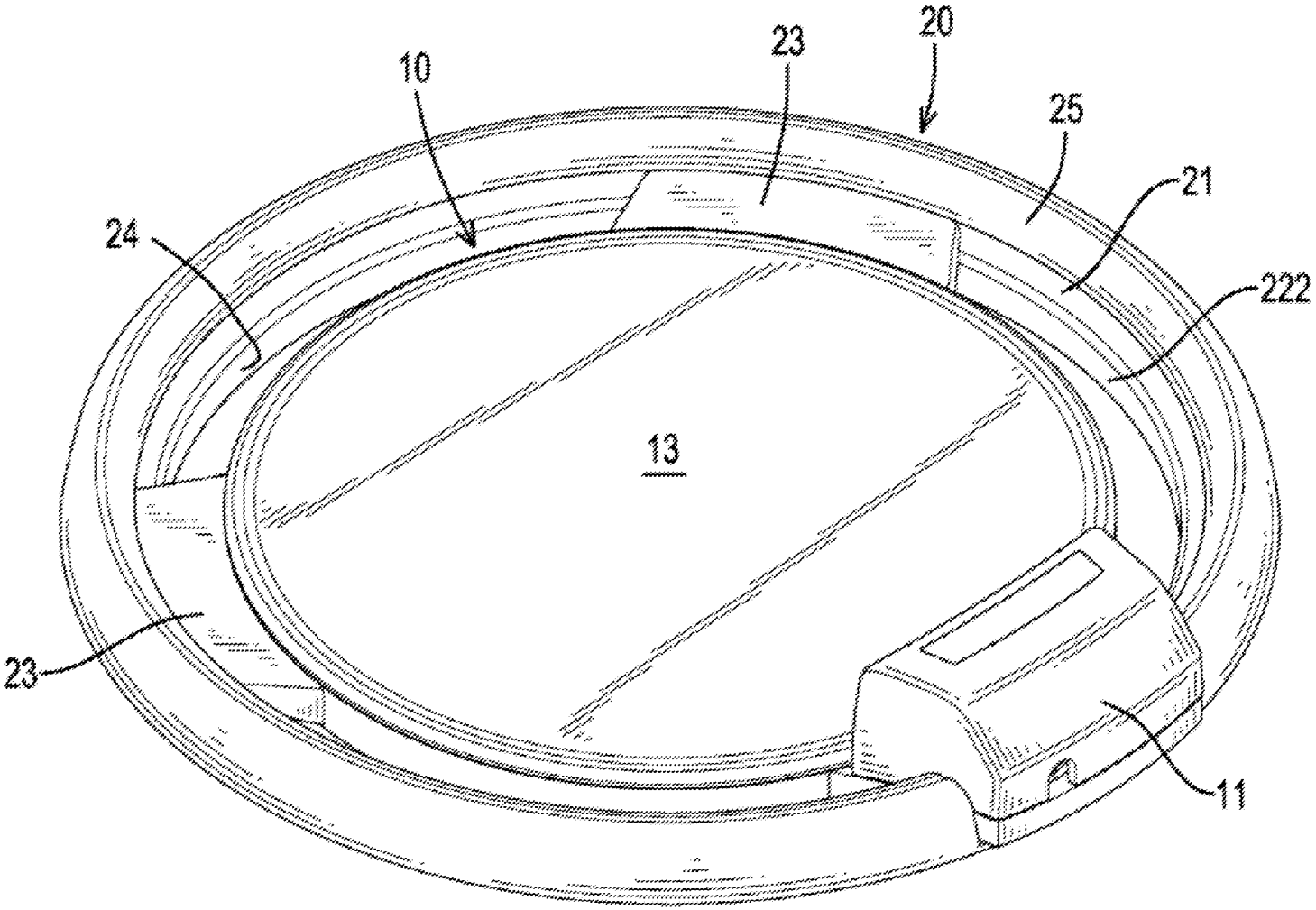
FIG. 1 is a perspective view of a first embodiment of an electronic drum in accordance with the present disclosure.
Figure 2:
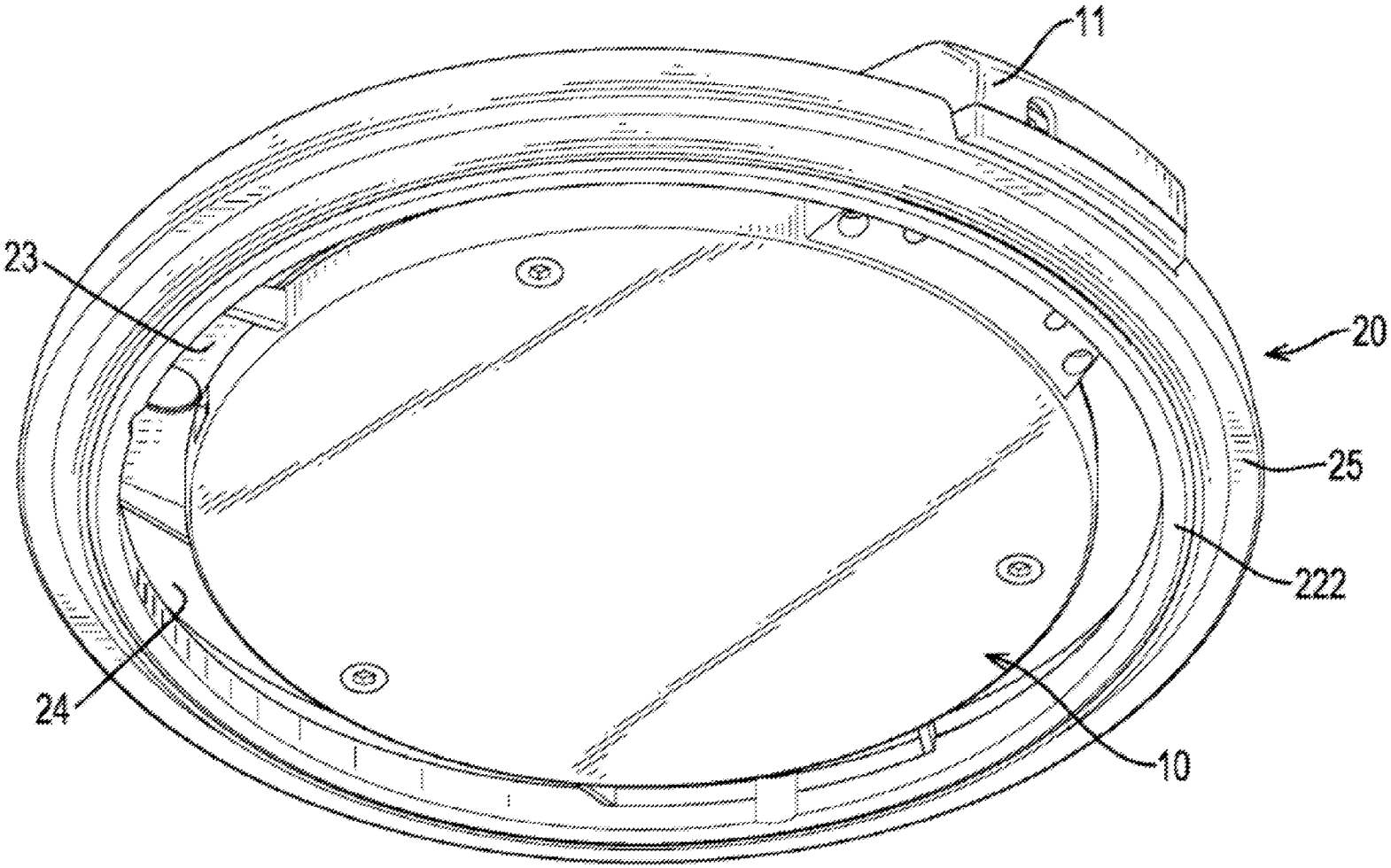
FIG. 2 is a bottom perspective view of the electronic drum in FIG. 1.
Figure 3:
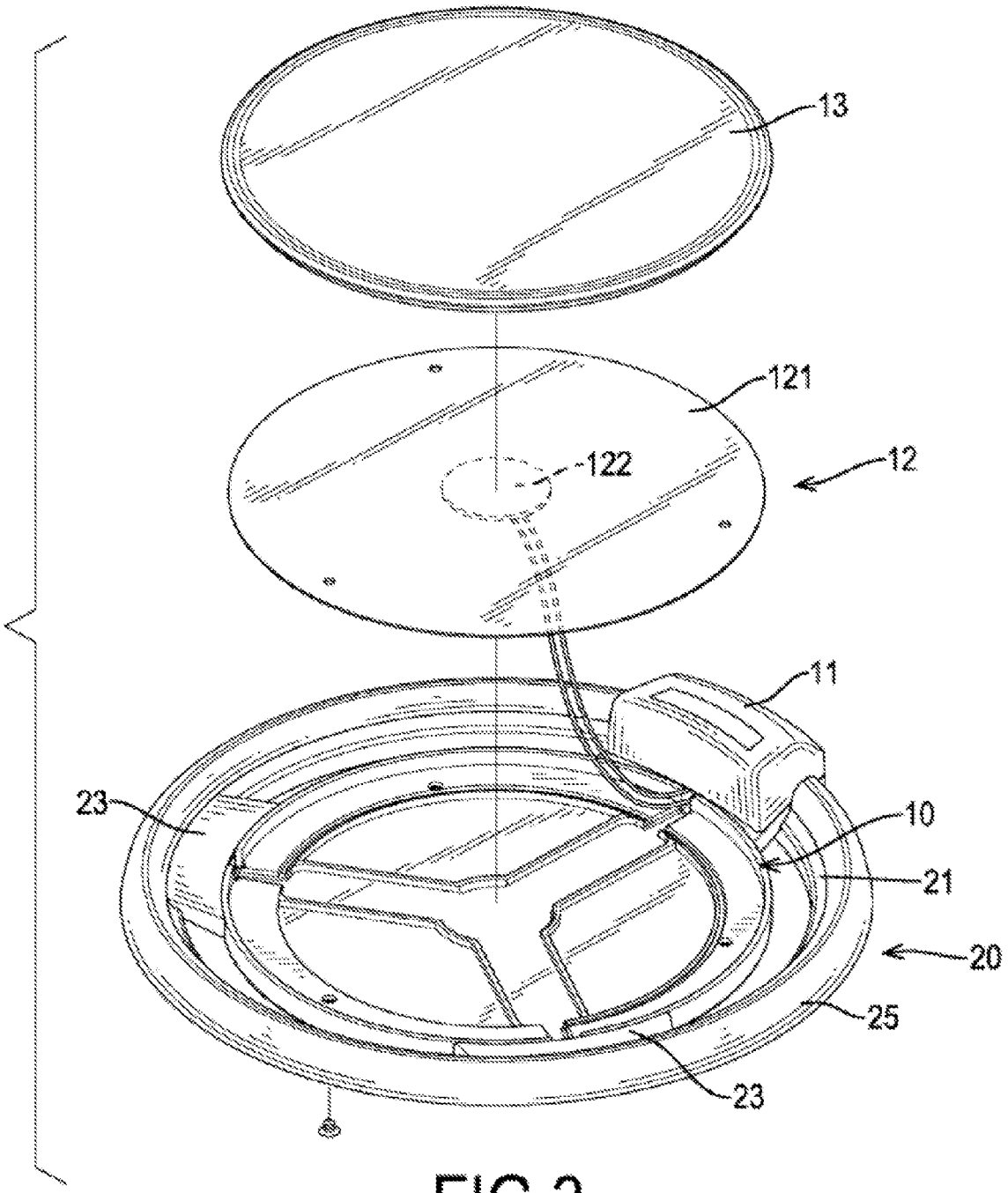
FIG. 3 is an exploded perspective view of the electronic drum in FIG. 1.

With reference to FIGS. 1 to 3, an electronic drum in accordance with the present disclosure comprises an induction board 10 and a securing frame 20.

The induction board 10 has a connection device 11, a drumhead 13 and a detecting assembly 12. The connection device 11 is adapted to be electrically connected with an outer acoustic device, such as a speaker or an earphone. The drumhead 13 is elastic and may be made of rubber. The detecting assembly 12 is mounted under the drumhead 13 and is electrically connected with the connection device 11 to detect beats on the drumhead 13 and to send acoustic signal to the connection device 11. Preferably, the detecting assembly 12 comprises a metal disk 121 and a sensor chip 122. The metal disk 121 is mounted under the drumhead 13 and has a bottom opposite to the drumhead 13. The sensor chip 122 is mounted on the bottom of the metal disk 121 to detect vibrations of the metal disk 121 and is electrically connected with the connection device 11 to send acoustic signal to the connection device 11.

Figure 6:
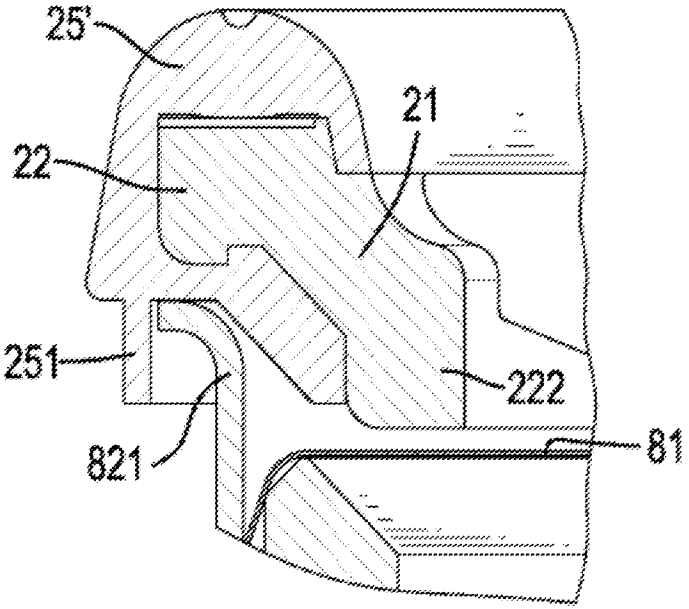
FIG. 6 is an enlarged cross sectional side view of the electronic drum in FIG. 4 attached to a drum.

The securing frame 20 is annular, is mounted around the induction board 10 and comprises an annular bracket 21, an outer securing rib 22 and a bottom securing rib 222. The annular bracket 21 is connected to the induction board 10 and has an outer periphery and a bottom. The outer securing rib 22 may be annular and protrudes outward from the outer periphery of the annular bracket 21, and the bottom securing rib 222 may be annular and protrudes from the bottom of the annular bracket 21. In addition, the securing frame 20 may further have multiple connecting panels 23 separately formed on and protruding from an inner periphery of the annular bracket 21 at intervals and connected to the induction board 10. Alternatively, with reference to FIG. 4, the securing frame 20' may further have an annular connection plate 23' formed on and protruding from an inner periphery of the annular bracket 21' and connected to the induction board 10. The connection plate 23' has multiple ventilation holes 24' formed through the connection plate 23'. In addition, with reference to FIG. 5, the securing frame 20 further has an annular elastic collar 25 mounted around the annular bracket 21 and the outer securing rib 22. With reference to FIG. 6, the annular elastic collar 25' has annular wall 251 formed on and protruding downward from a bottom of the annular elastic collar 25'.

Figure 7A:
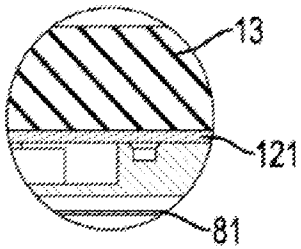
FIG. 7A is an enlarged cross sectional side view of the electronic drum in FIG. 7.
Figure 7:
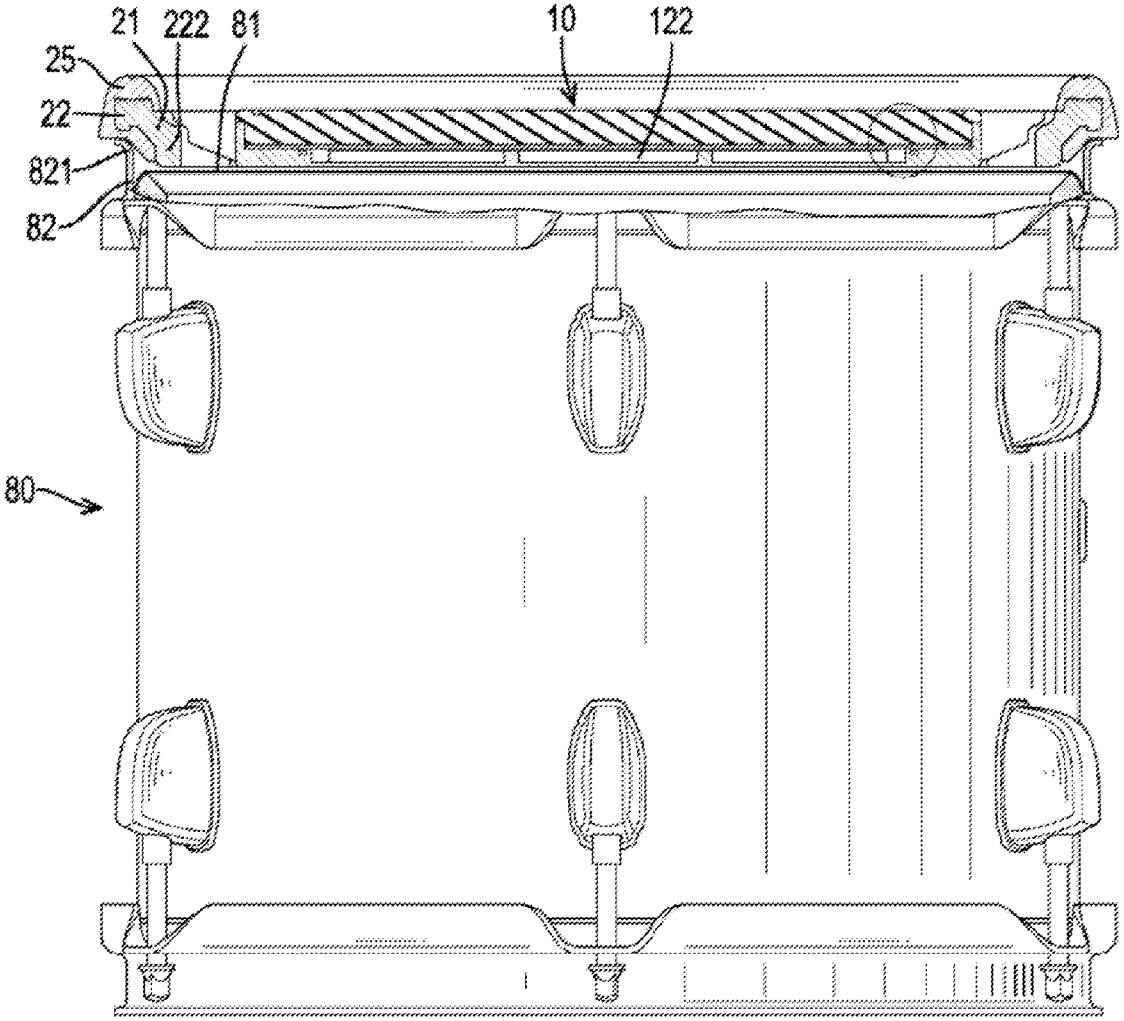
FIG. 7 is a side view in partial section of the electronic drum in FIG. 1 attached to a drum.

With reference to FIGS. 1, 7 and 7A, to attach the electronic drum onto a drum 80, the annular bracket 21 of the securing frame 20 is attached to a holding rim 82 of the drum 80. The outer securing rib 22 and the bottom securing rib 222 respectively abut against the top and the inner periphery of the holding rim 82, such that the induction board 10 can be securely held above the drumhead 81 of the drum 80. When the induction board 10 is beaten, the sensor chip 122 can detect the vibrations of the metal plate 121 and sends acoustic signal to the connection device 11. Then, the connection device 11 can send signal and actuate the outer acoustic device, such a speaker or an earphone to generate acoustic sound. Because the sound volume generated by the outer acoustic device can be adjusted, to noise the other people can be prevented while a user is practicing with the electronic drum in accordance with the present disclosure. With the arrangement of the bottom securing rib 222 that abuts against the inner periphery of the holding rim 82, the position of the induction board 10 can be kept from being shifted. With the arrangement of the outer securing rib 22, the securing frame 20 can be stably mounted on and fitted with different drums 80 having different holding rims 82 of different sizes.

In addition, because the holding rim 82 of the drum 80 always has a protruding flange 821, the securing frame 20 is mounted on the protruding flange 821 to enable the induction board 10 to space from the drumhead 81 of the drum 80. Therefore, the drumhead 81 of the drum 80 will not be vibrated while the user beats the induction board 10 so as to keep the drum 80 from generating acoustic sound.

Furthermore, with the separating connecting panels 23 as shown in FIG. 3, multiple intervals 24 are formed between the connecting panels 23, such that the space between the induction board 10 and the drumhead 81 of the drum 80 is not enclosed or sealed. Thus, the air in the space between the induction board 10 and the drumhead 81 of the drum 80 will not be compressed while the induction board 10 is beaten, such that the drum 80 can be effectively prevented from generating acoustic sound.

Figure 4:
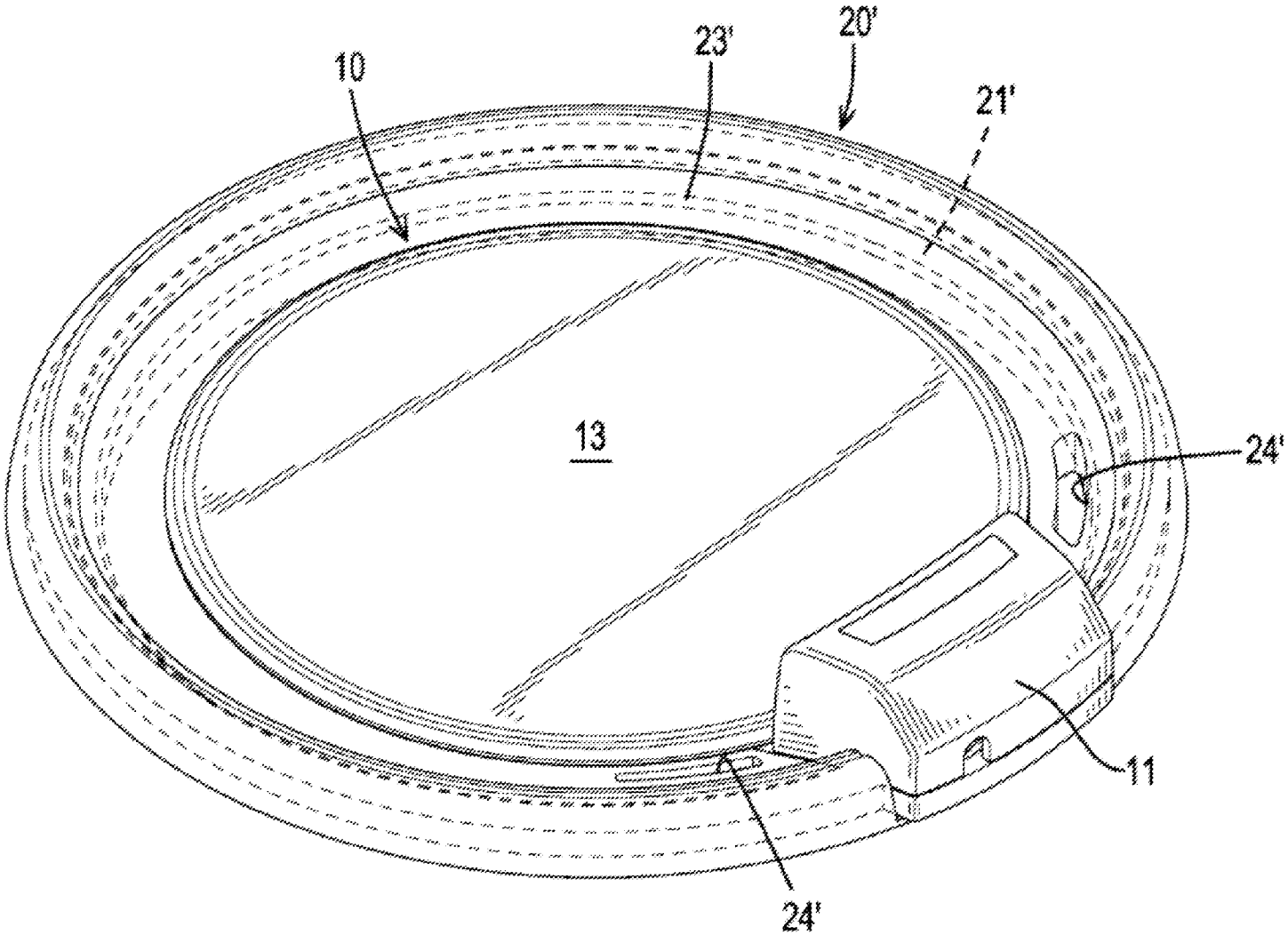
FIG. 4 is a perspective view of a second embodiment of an electronic drum in accordance with the present disclosure.
Figure 5:
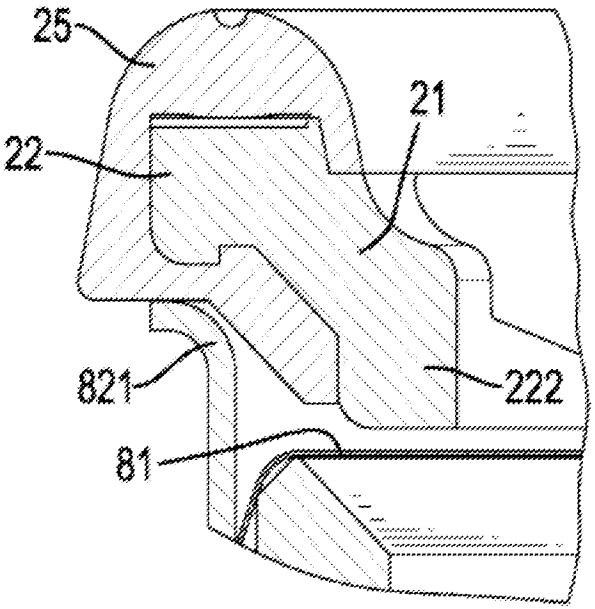
FIG. 5 is an enlarged cross sectional side view of the electronic drum in FIG. 1 attached to a drum.

The annular connection plate 23' as shown in FIG. 4 can increase the connection area between the annular bracket 21' and the induction board 10, such that the connection strength between the annular bracket 21' and the induction board 10 can be effectively improved. The ventilation holes 24' in the connection plate 23' can also prevent the air in the space between the induction board 10 and the drumhead 81 of the drum 80 from being compressed and vibrated, such that the drum 80 can be effectively prevented from generating acoustic sound.

The annular wall 251 on the annular elastic collar 25' is mounted around the protruding flange 821 of the holding rim 82 on the drum 80 to hold the protruding flange 821 between the bottom securing rib 22 and the annular wall 251, such that the shift of the electronic drum in accordance with the present disclosure can be effectively prevented.

Accordingly, the electronic drum can be easily and conveniently attached to or detached from a drum 80, so to attach and detach multiple drums and electronic drums onto or from a stand for playing music or to practicing is unnecessary and to use the electronic drums in accordance with the present disclosure is convenient.

Figure 8:
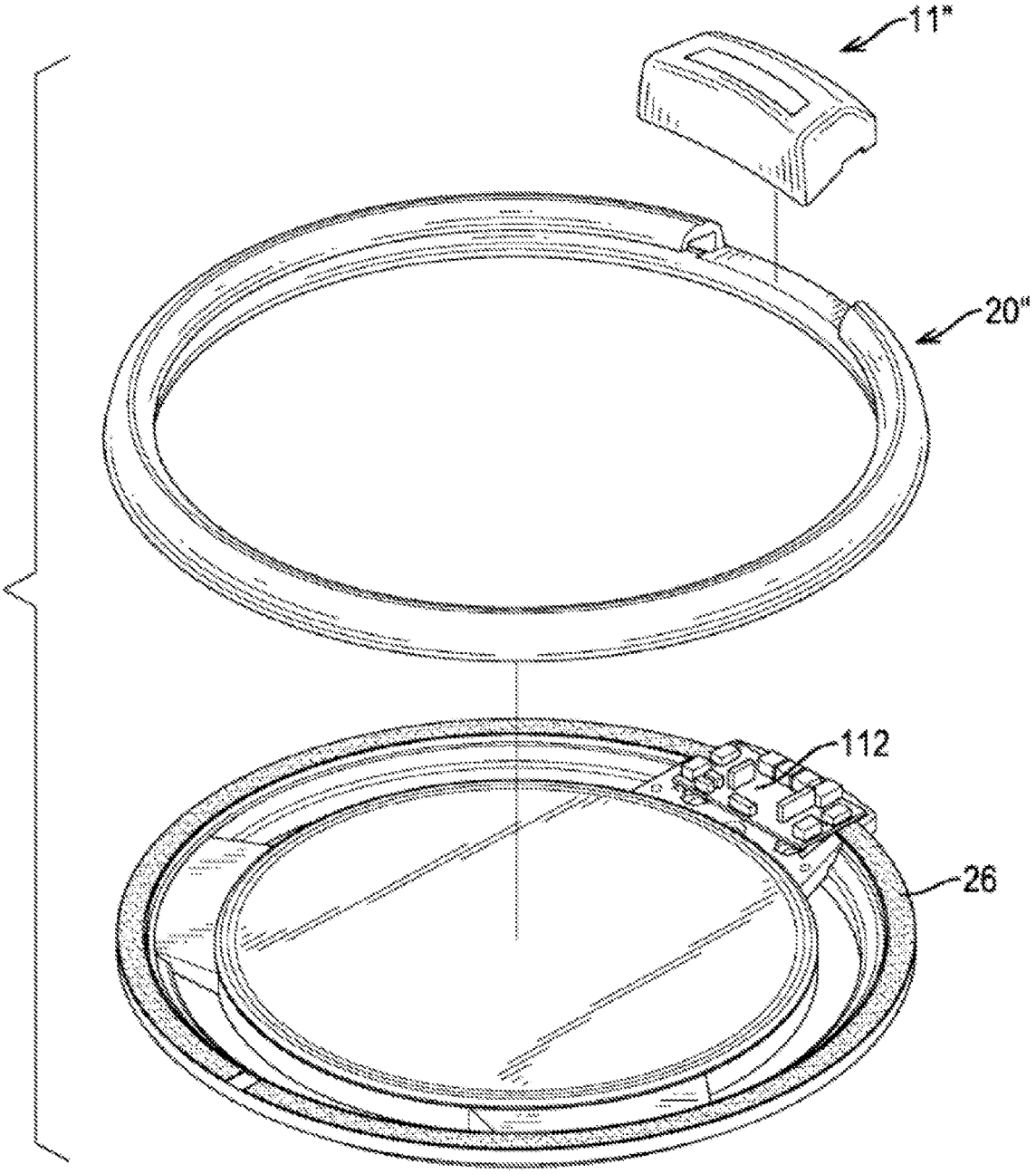
FIG. 8 is an exploded perspective view of a third embodiment of a securing frame of an electronic drum in accordance with the present disclosure.
Figure 9:
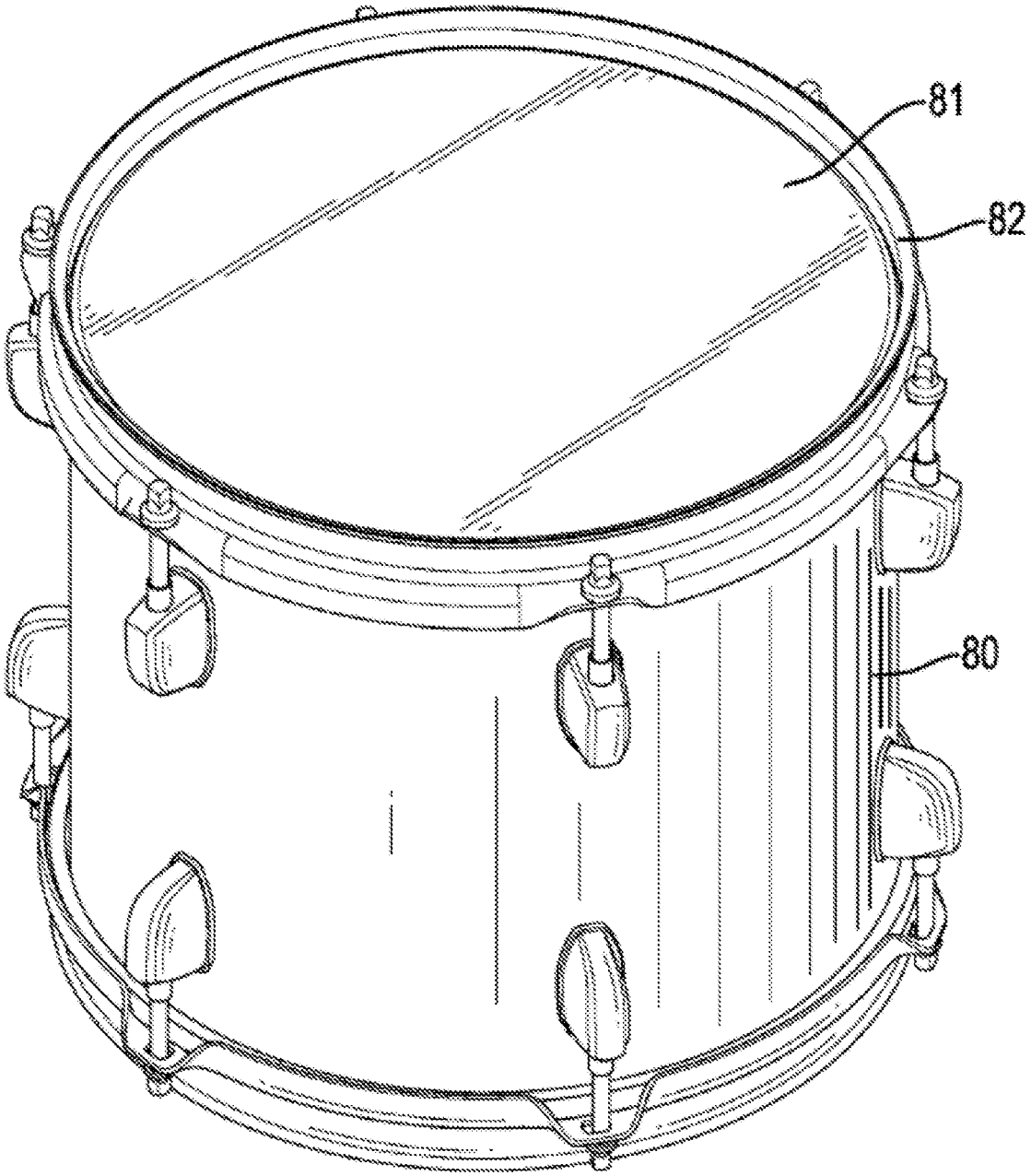
FIG.9 PRIOR ART
FIG. 9 is a perspective view of a conventional drum in accordance with the prior art.
Figure 10:
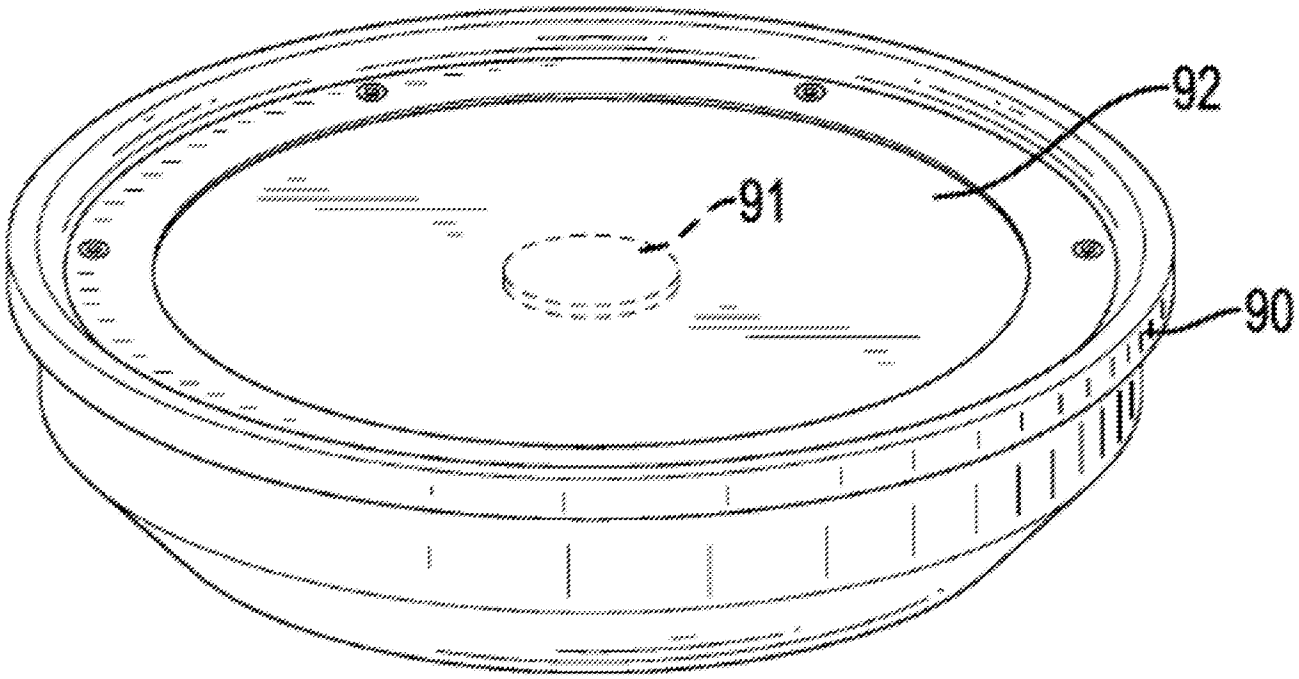
FIG.10 PRIOR ART
FIG. 10 is a perspective view of a conventional electronic drum in accordance with the prior art.
Figure 11:
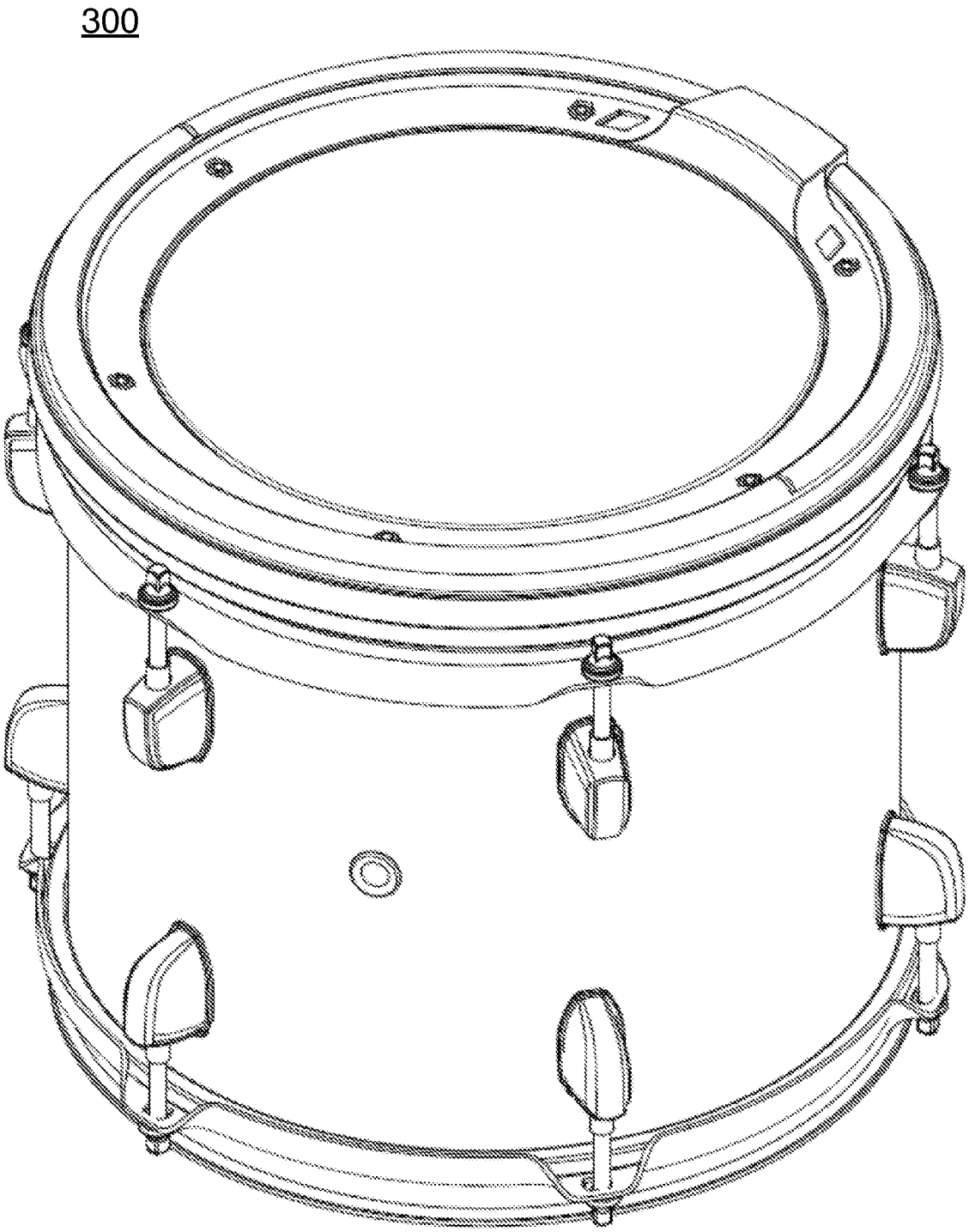
FIG. 11 is a perspective view of an assembly of a fourth embodiment of an electronic drum and a conventional drum in accordance with the present disclosure.
Figure 12:
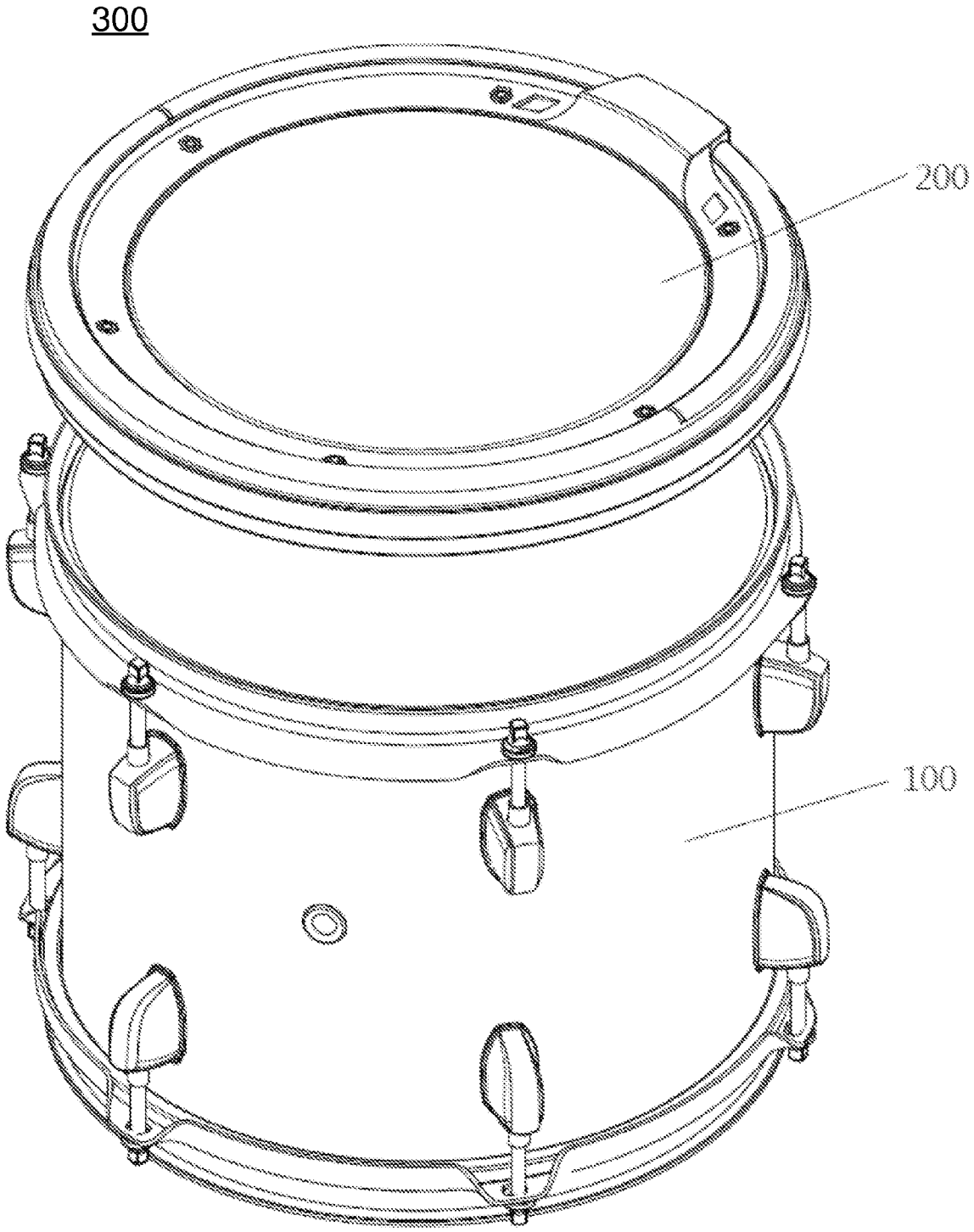
FIG. 12 is an exploded view of the assembly of the fourth embodiment of an electronic drum and an acoustic drum in accordance with the present disclosure.
Figure 13:
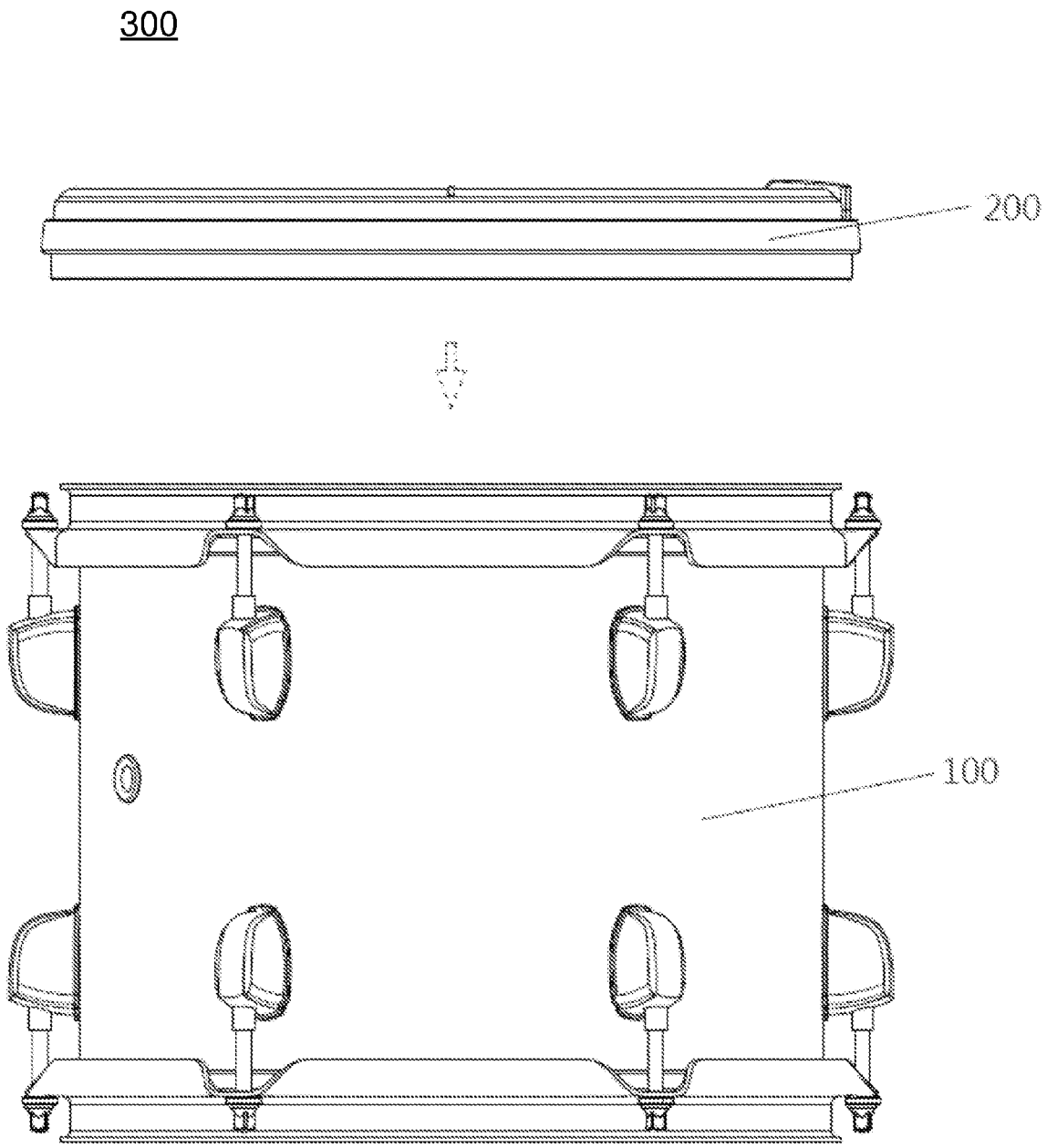
FIG. 13 is another exploded view of the assembly of the fourth embodiment of an electronic drum and an acoustic drum in accordance with the present disclosure.

With reference to FIG. 8, the securing frame 20" further has two membrane switches 26 mounted in the securing frame 20" and electrically connected to a circuit board 112 in the connection device 11". Preferably, each membrane switch 26 is curved and is 180° in curvature. With the membrane switches 26, when the securing frame 20" is beaten, the membrane switches 26 can detect the vibrations of the securing frame 20" and sends acoustic signal to the connection device 11" to actuate an outer acoustic device to generate acoustic sound. Accordingly, the user can beat the securing frame 20" to simulate the action of beating on a drum rim, such that the electronic drum in accordance with the present disclosure is versatile in use.

FIGS. 11 to 15 illustrate various views of an assembly 300 of a fourth embodiment of an electronic drum 200 and a conventional drum 100 in accordance with the present disclosure.

Figure 14:
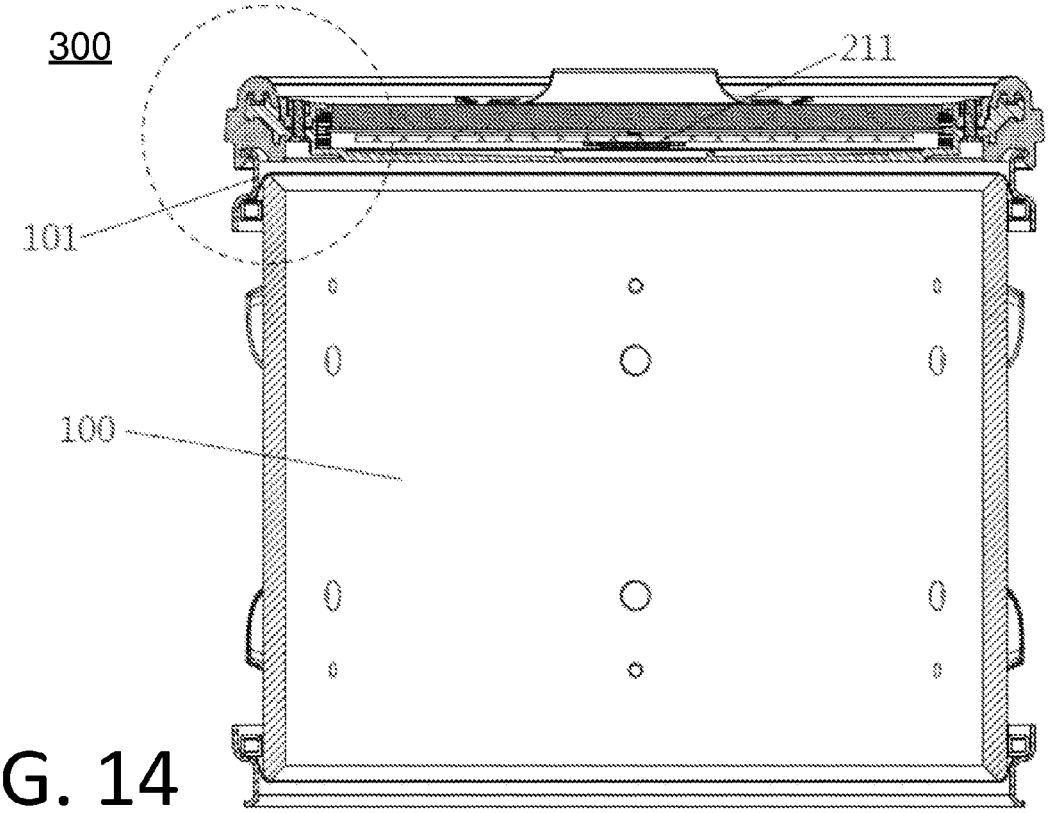
FIG. 14 is a cross-sectional view of the assembly of the fourth embodiment of an electronic drum and an acoustic drum in accordance with the present disclosure.
Figure 15:
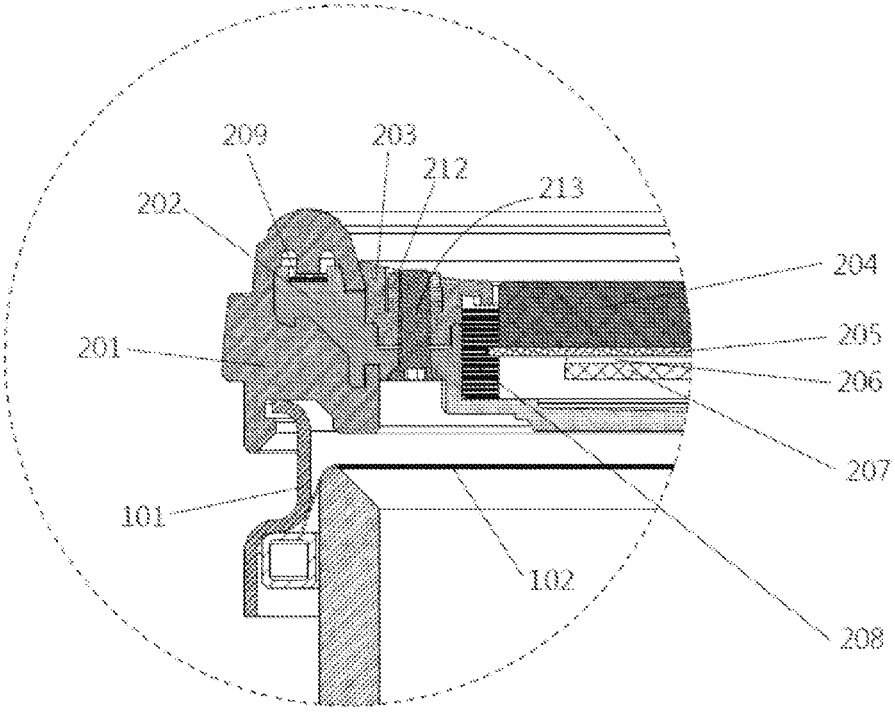
FIG. 15 is a partial enlarged view of FIG. 14.

As shown in FIGS. 14 and 15, conventional drum 100 includes a drum hoop 101 and a drumhead 102. Conventional drum 100 may be, for example, a snare drum, tom-tom, floor tom or marching drum. In other words, conventional drum 100 may be an acoustic drum of any given size. Electronic drum 200 may be sized accordingly to fit onto conventional drum 100. As shown in FIGS. 11 to 15, electronic drum 200 is configured to be detachably mountable over drumhead 102 of conventional drum 100. Advantageously, the proposed design of the present disclosure allows a user to convert conventional drum 100 from an acoustic drum to a digital, non-acoustic drum by attaching, coupling or otherwise mounting electronic drum 200 over either one of the two drumheads of conventional drum 100, without either the need of disassembling any part of conventional drum 100 or the need of attaching additional mechanism to mount electronic drum 200 on conventional drum 100. Additionally, the proposed design of the present disclosure allows the user to remove or otherwise detach electronic drum 200 from conventional drum 100 without the need of removing any part from conventional drum 100.

As shown in FIGS. 14 and 15, electronic drum 200 includes a number of components including, but not limited to, an annular elastic collar 201, a main support base 202, an annular top cover 203 for the main support base 202, an elastic pad 204, a metal plate 205, one or more vibration damping members 206, a vibration resonance member 207, an edge sensor element 209, one or more screw nuts 212 and one or more bolts 213. Annular elastic collar 201 is shaped and configured to hitch or otherwise hook the drum hoop 101 of conventional drum 100 when the electronic drum 200 is attached to or otherwise mounted over drumhead 102 of conventional drum 100. As shown in FIGS. 14 and 15, the cross-sectional view of a lower part of annular elastic collar 201 resembles a hook. This allows the electronic drum 200 to be attached to and detached from conventional drum 100 without disassembling any part of conventional drum 100 for attaching or attaching additional mechanism for detaching, respectively.

As shown in FIG. 15, when the electronic drum 200 is attached to or otherwise mounted over drumhead 102 of conventional drum 100, no other parts of electronic drum 200 other than annular elastic collar 201 is in physical contact with conventional drum 100. More specifically, when the electronic drum 200 is attached to or otherwise mounted over drumhead 102 of conventional drum 100, annular elastic collar 201 of electronic drum 200 is in physical contact with drum hoop 101 of conventional drum 100. That is, the main portion of the electronic drum 200 is suspended over and not in contact with drumhead 102 of conventional drum 100. This design prevents the electronic drum 200 from contacting drumhead 102 of conventional drum 100 to generate sound when electronic drum 200 is in use (e.g., being struck by a user).

Figure 16:
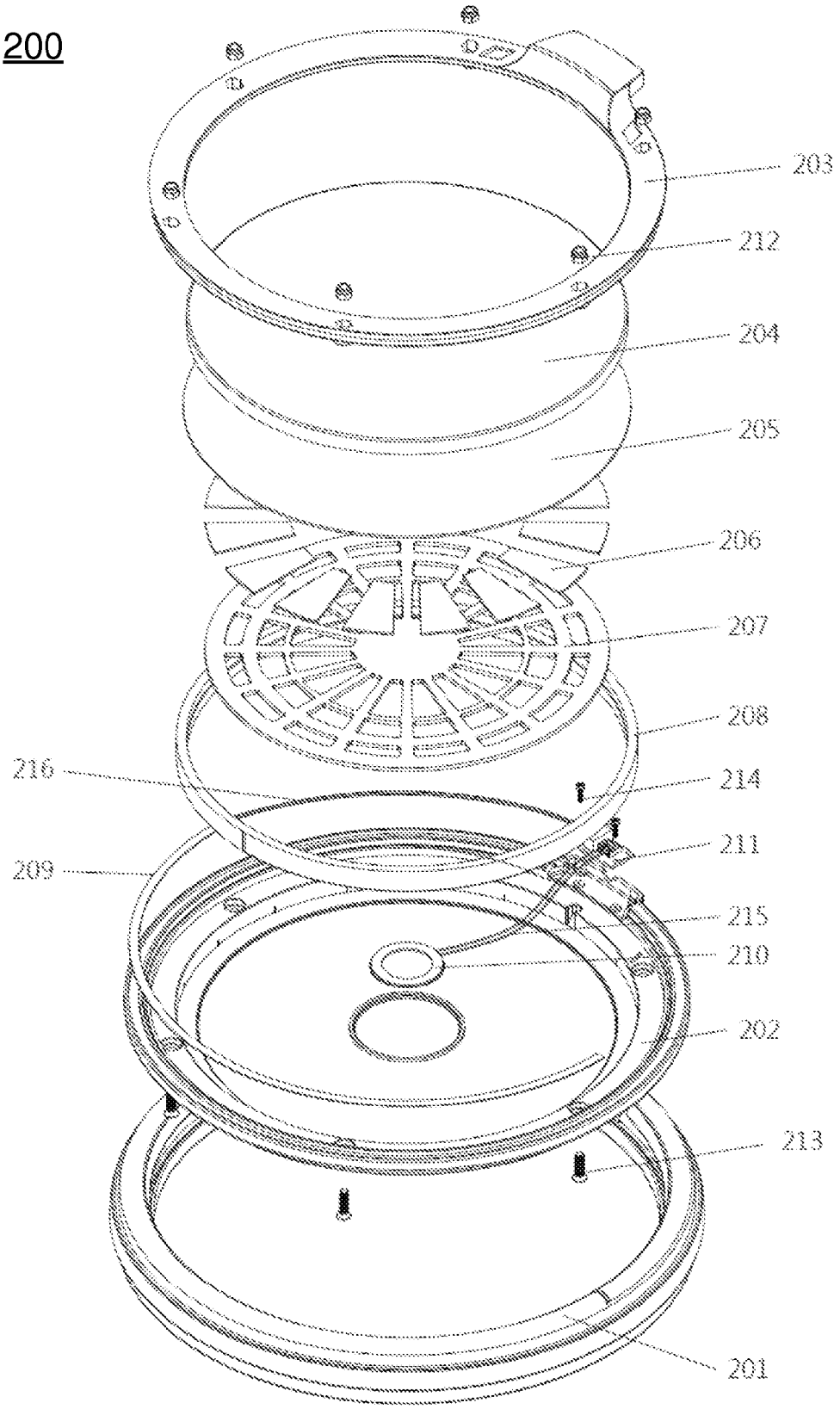
FIG. 16 is an exploded view of the fourth embodiment of an electronic drum in accordance with the present disclosure.
Figure 17:
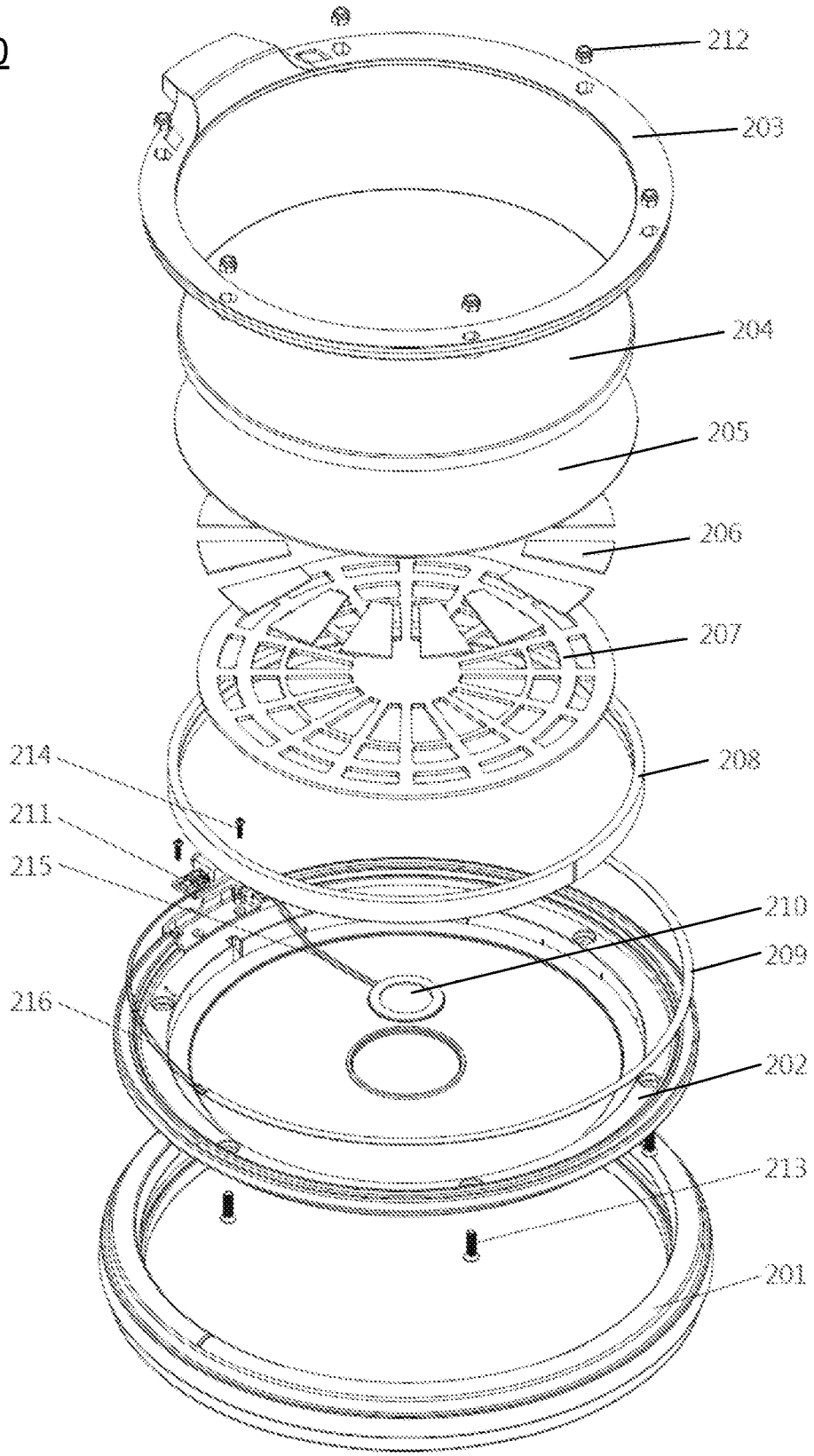
FIG. 17 is another exploded view of the fourth embodiment of an electronic drum in accordance with the present disclosure.

FIGS. 16 and 17 illustrate the electronic drum 200 in accordance with the present disclosure.

As shown in FIGS. 16 and 17, electronic drum 200 includes annular elastic collar 201, main support base 202, annular top cover 203 for the main support base 202, elastic pad 204, metal plate 205, one or more vibration damping members 206, vibration resonance member 207, a suspension ring 208 for the elastic pad 204 and metal plate 205, edge sensor element 209, a central sensor element 210, a circuit board 211, one or more screw nuts 212, one or more bolts 213, one or more screws 214 to secure circuit board 211 to main support base 202, a cable wire 215 connecting the central sensor element 210 and circuit board 211, and a cable wire 216 connecting the edge sensor element 209 and circuit board 211.

In some embodiments, annular elastic collar 201 may be made of an elastic material such as, for example, rubber or silicone. In some embodiments, main support base 202 may be made of plastic. In some embodiments, elastic pad 204 may be made of an elastic material such as, for example, silicone or rubber. In some embodiments, metal plate 205 may be made of steel. In some embodiments, the one or more vibration damping members 206 may be made of an elastic material such as, for example, foam or silicone. In some embodiments, vibration resonance member 207 may be made of plastic or metal. In some embodiments, either or both of edge sensor element 209 and central sensor element 210 may be a piezoelectric sensor. In some embodiments, edge sensor element 209 may be a sheet sensor.

In some embodiments, a shape of vibration resonance member 207 may generally resemble a spider web. For example, vibration resonance member 207 may include a hub portion, a plurality of radial portions extending radially from the hub portion, and a plurality of spiral portions. Each of the spiral portions may be disposed between and connects respective two of the radial portions. Each of the radial portions may be connected to a respective adjacent one of the radial portions by one or more of the spiral portions.

Figure 18:
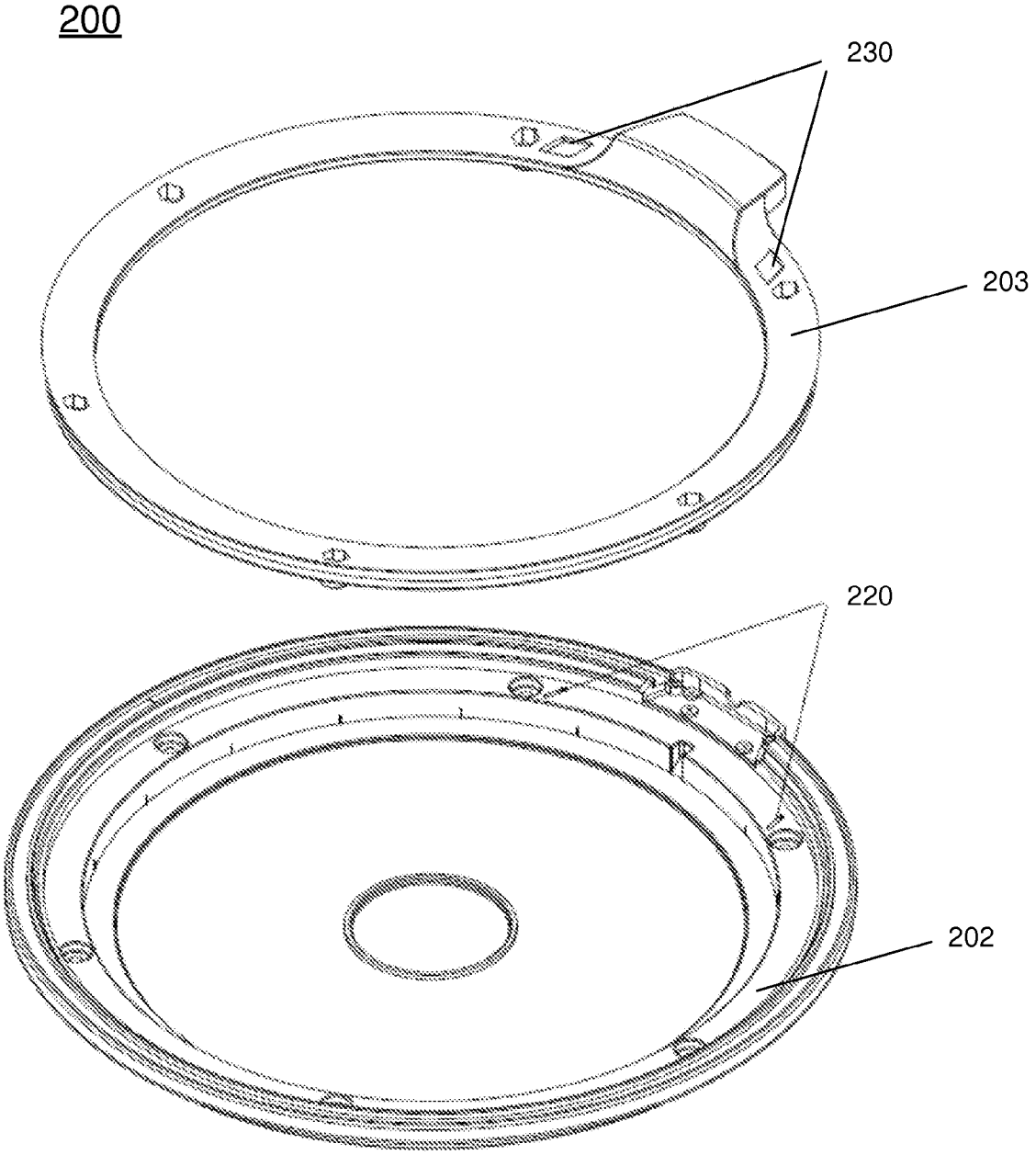
FIG. 18 shows locations of wind holes on the fourth embodiment of an electronic drum in accordance with the present disclosure.

FIG. 18 illustrates locations of wind holes on the electronic drum 200 in accordance with the present disclosure.

Each of main support base 202 and annular top cover 203 includes one or more wind holes, respectively. In the example shown in FIG. 18, support base 202 includes two wind holes 220 and annular top cover 203 includes two wind holes 230 corresponding to and aligned with wind holes 220. Air trapped between electronic drum 200 and drumhead 102 of conventional drum 100 may be released through wind holes 220 and 230. Again, this design also prevents beating of the electronic drum 200 from causing drumhead 102 of conventional drum 100 to generate sound due to air trapped therebetween when electronic drum 200 is in use (e.g., being struck by a user).

Those skilled in the art would appreciate that, although two wind holes 220 and two wind holes 230 are shown in FIG. 18, in various embodiments, main support base 202 may have a different number (more or less) of wind holes 220 and annular top cover 203 may have a different number (more or less) of wind holes 230. Moreover, in various embodiments, the location of each wind hole 220 and the location of each wind hole 230 may be different than those shown in FIG. 18.

Figure 19:
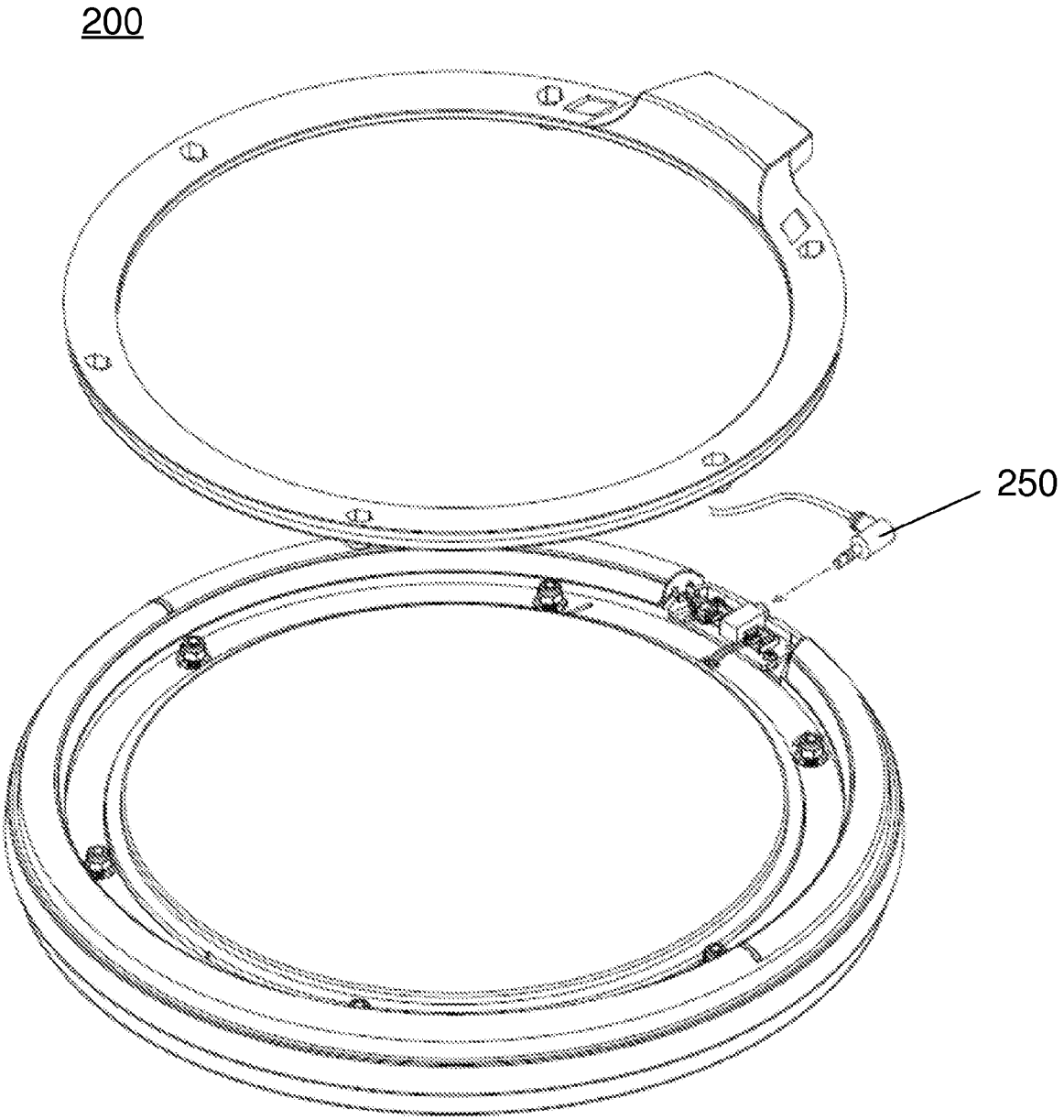
FIG. 19 shows an electric power cord for powering the fourth embodiment of an electronic drum in accordance with the present disclosure.

FIG. 19 illustrates an electric power cord 250 for powering the electronic drum 200 in accordance with the present disclosure. As shown in FIG. 19, electric power cord 250 may be plugged into a receptacle on circuit board 211 to supply electric power to circuit board 211 and other components of electronic drum 200 (e.g., edge sensor element 209 and central sensor element 210) that need electric power for operation.

In view of the above, highlights of inventive features of electronic drum 200 are provided below. In one aspect, an electronic drum in accordance with the present disclosure may include a main support base, a striking unit, an annular top cover, and an annular elastic collar. The main support base may include a central portion and a periphery surrounding the central portion. The striking unit may be disposed on the central portion of the main support base. The striking unit may include a number of components, including: a circuit board, a first sensor element disposed on the central portion of the main support base and electrically coupled to the circuit board, a vibration resonance member disposed over the first sensor element, one or more vibration damping members disposed on the vibration resonance member, a metal plate disposed on the one or more vibration damping members, and an elastic pad disposed on the metal plate. The annular top cover may be disposed over and around the striking unit such that the striking unit is disposed between the main support base and the annular top cover. The annular elastic collar may be coupled to the periphery of the main support base. The annular elastic collar may be configured to hook to a drum hoop of a conventional drum when the electronic drum is attached to the conventional drum and disposed over a drumhead of the conventional drum such that no other portion of the electronic drum is in contact with the conventional drum.

In some embodiments, the annular elastic collar may be further configured such that the electronic drum is detachably mountable over the drumhead of the conventional drum without an external mechanism.

In some embodiments, the main support base may include at least one first wind hole fluidly connecting a first side of the main support base and a second side of the main support base opposite the first side thereof. The first side of the main support base may face the conventional drum when the electronic drum is disposed over the conventional drum. Additionally, the annular top cover may include at least one second wind hole fluidly connecting a first side of the annular top cover and a second side of the annular top cover opposite the first side thereof. The first side of the annular top cover may face the main support base when the annular top cover is disposed over the main support base. Each of the at least one second wind hole may correspond to and be aligned with a respective one of the at least one first wind hole.

In some embodiments, the first sensor element may include a piezoelectric sensor.

In some embodiments, the annular elastic collar may be made of rubber or silicone.

In some embodiments, the elastic pad may be made of rubber or silicone.

In some embodiments, the metal plate may be made of steel.

In some embodiments, the one or more vibration damping members may be made of foam.

In some embodiments, the vibration resonance member may be made of plastic or metal.

In some embodiments, the vibration resonance member may be configured to resonate with vibrations. The vibration resonance member may include: a hub portion, a plurality of radial portions extending radially from the hub portion, and a plurality of spiral portions. Each of the spiral portions may be disposed between and connects respective two of the radial portions. Each of the radial portions may be connected to a respective adjacent one of the radial portions by one or more of the spiral portions.

In some embodiments, a shape of the vibration resonance member may generally resemble a spider web.

In some embodiments, the conventional drum may be a snare drum, a tom-tom, a floor tom or a marching drum.

In some embodiments, the electronic drum may further include a suspension ring disposed between the main support base and the annular top cover. The suspension ring may be configured to support the elastic pad and the metal plate.

In some embodiments, the periphery of the main support base may include a groove on the second side of the main support base. Additionally, the electronic drum may further include a second sensor element disposed in the groove and between the annular elastic cover and the periphery of the main support base. The second sensor may be electrically coupled to the circuit board.

In some embodiments, the second sensor element may include a sheet sensor.

In some embodiments, the electronic drum may further include mechanical means configured to couple the main support base and the annular top cover together. In some embodiments, the mechanical means may include one or more nuts and one or more bolts corresponding to the one or more nuts.

Even though numerous characteristics and advantages of the present disclosure have been set forth in the foregoing description, together with details of the structure and function of the present disclosure, the disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electronic drum, comprising:

a main support base having a central portion and a periphery surrounding the central portion;

a striking unit disposed on the central portion of the main support base, the striking unit comprising:

a circuit board;

a first sensor element disposed on the central portion of the main support base and electrically coupled to the circuit board;

a vibration resonance member disposed over the first sensor element;

one or more vibration damping members disposed on the vibration resonance member;

a metal plate disposed on the one or more vibration damping members; and an elastic pad disposed on the metal plate;

an annular top cover disposed over and around the striking unit such that the striking unit is disposed between the main support base and the annular top cover; and an annular elastic collar coupled to the periphery of the main support base, the annular elastic collar configured to hook to a drum hoop of a conventional drum when the electronic drum is attached to the conventional drum and disposed over a drumhead of the conventional drum such that no other portion of the electronic drum is in contact with the conventional drum.

2. The electronic drum of claim 1, wherein the annular elastic collar is configured such that the electronic drum is detachably mountable over the drumhead of the conventional drum without an external mechanism.

3. The electronic drum of claim 1, wherein the main support base comprises at least one first wind hole fluidly connecting a first side of the main support base and a second side of the main support base opposite the first side thereof, the first side of the main support base facing the conventional drum when the electronic drum is disposed over the conventional drum.

4. The electronic drum of claim 3, wherein the annular top cover comprises at least one second wind hole fluidly connecting a first side of the annular top cover and a second side of the annular top cover opposite the first side thereof, the first side of the annular top cover facing the main support base when the annular top cover is disposed over the main support base, each of the at least one second wind hole corresponding to and aligned with a respective one of the at least one first wind hole.

5. The electronic drum of claim 1, wherein the first sensor element comprises a piezoelectric sensor.

6. The electronic drum of claim 1, wherein the annular elastic collar is made of rubber or silicone.

7. The electronic drum of claim 1, wherein the elastic pad is made of rubber or silicone.

8. The electronic drum of claim 1, wherein the metal plate is made of steel.

9. The electronic drum of claim 1, wherein the one or more vibration damping members are made of foam.

10. The electronic drum of claim 1, wherein the vibration resonance member is made of plastic or metal.

11. The electronic drum of claim 1, wherein the vibration resonance member is configured to resonate with vibrations, the vibration resonance member comprising:

a hub portion;

a plurality of radial portions extending radially from the hub portion; and a plurality of spiral portions, wherein:

each of the spiral portions is disposed between and connects respective two of the radial portions, and each of the radial portions is connected to a respective adjacent one of the radial portions by one or more of the spiral portions.

12. The electronic drum of claim 1, wherein a shape of the vibration resonance member generally resembles a spider web.

13. The electronic drum of claim 1, wherein the conventional drum comprises a snare drum, a tom-tom, a floor tom or a marching drum.

14. The electronic drum of claim 1, further comprising:

a suspension ring disposed between the main support base and the annular top cover, the suspension ring configured to support the elastic pad and the metal plate.

15. The electronic drum of claim 1, wherein the periphery of the main support base comprises a groove on the second side of the main support base.

16. The electronic drum of claim 15, further comprising:

a second sensor element disposed in the groove and between the annular elastic cover and the periphery of the main support base, the second sensor electrically coupled to the circuit board.

17. The electronic drum of claim 16, wherein the second sensor element comprises a sheet sensor.

18. The electronic drum of claim 1, further comprising:

mechanical means configured to couple the main support base and the annular top cover together.

19. The electronic drum of claim 18, wherein the mechanical means comprise one or more nuts and one or more bolts corresponding to the one or more nuts.

20. An electronic drum, comprising:

a main support base having a central portion and a periphery surrounding the central portion;

a striking unit disposed on the central portion of the main support base, the striking unit comprising:

a circuit board;

a first sensor element disposed on the central portion of the main support base and electrically coupled to the circuit board;

a vibration resonance member disposed over the first sensor element;

one or more vibration damping members disposed on the vibration resonance member;

a metal plate disposed on the one or more vibration damping members; and an elastic pad disposed on the metal plate;

an annular top cover disposed over and around the striking unit such that the striking unit is disposed between the main support base and the annular top cover; and an annular elastic collar coupled to the periphery of the main support base, the annular elastic collar configured to hook to a drum hoop of a conventional drum when the electronic drum is attached to the conventional drum and disposed over a drumhead of the conventional drum, wherein the main support base comprises at least one first wind hole fluidly connecting a first side of the main support base and a second side of the main support base opposite the first side thereof, the first side of the main support base facing the conventional drum when the electronic drum is disposed over the conventional drum, and wherein the annular top cover comprises at least one second wind hole fluidly connecting a first side of the annular top cover and a second side of the annular top cover opposite the first side thereof, the first side of the annular top cover facing the main support base when the annular top cover is disposed over the main support base, each of the at least one second wind hole corresponding to and aligned with a respective one of the at least one first wind hole.

* * * * *